US007845037B2

(12) United States Patent
Frushtick

(10) Patent No.: US 7,845,037 B2
(45) **Date of Patent: *Dec. 7, 2010**

(54) TRIPLE PASS TUNNEL FINISHER

(75) Inventor: Jeffrey Neal Frushtick, Denver, NC (US)

(73) Assignee: Leonard Automatics, Inc., Denver, NC (US)

( * ) Notice: Subject to any disclaimer, the term of this patent is extended or adjusted under 35 U.S.C. 154(b) by 1225 days.

This patent is subject to a terminal disclaimer.

(21) Appl. No.: 11/421,247

(22) Filed: May 31, 2006

(65) Prior Publication Data

US 2006/0272178 A1 Dec. 7, 2006

Related U.S. Application Data

(60) Provisional application No. 60/685,900, filed on May 31, 2005.

(51) Int. Cl.
*D06B 3/30* (2006.01)

(52) U.S. Cl. ..... 8/149.3; 8/149.1; 8/149.2; 68/5 C; 68/5 E; 68/20; 34/216; 34/218; 38/1 R; 38/14

(58) Field of Classification Search ..... 68/3 R, 68/5 C, 5 D, 5 E, 10, 20, 205 R; 8/148, 149, 8/149.1, 149.2, 149.3; 34/134, 216, 218, 34/376, 389, 621; 38/1 R, 14, 7, 82
See application file for complete search history.

(56) References Cited

U.S. PATENT DOCUMENTS 2,859,902 A * 11/1958 Jordan ..... 223/63
3,644,085 A * 2/1972 Beeley et al. ..... 8/150
3,686,899 A 8/1972 Rosenfeld et al.
3,696,523 A * 10/1972 Beeley et al. ..... 34/216
3,732,628 A * 5/1973 Blevens et al. ..... 34/389
4,032,294 A * 6/1977 Thompson et al. ..... 8/116.4
4,070,876 A * 1/1978 Thompson et al. ..... 68/3 R
4,304,053 A * 12/1981 Kellerhals et al. ..... 34/621
5,018,371 A 5/1991 Riba
5,046,335 A * 9/1991 Riba ..... 68/5 C
5,276,978 A 1/1994 Hopkins et al.
5,459,301 A 10/1995 Miller et al.
5,651,192 A 7/1997 Horwitz
6,311,526 B1 11/2001 Frushtick

OTHER PUBLICATIONS

Exhibit A, 1 Pg., Sep. 2006.

* cited by examiner

*Primary Examiner*—Joseph L Perrin
*Assistant Examiner*—Benjamin Osterhout
(74) *Attorney, Agent, or Firm*—Adams Intellectual Property Law

(57) ABSTRACT

A triple pass tunnel finisher for finishing fabric. The finisher includes a side module, a front module, and a rear module. The side module includes an entrance for receiving a fabric piece to be conveyed through the apparatus, and a steam injection chamber downstream of the entrance for treating the fabric piece with steam. The front module communicates with the side module to receive the fabric piece conveyed therefrom, and includes first and second hot air chambers, and an exit downstream of the second hot air chamber. The rear module communicates with the front module to receive the fabric piece therefrom, and includes a heating apparatus for heating the fabric piece, and a U-shaped intermediate hot air chamber downstream from the first hot air chamber and upstream from the second hot air chamber for receiving the fabric piece from the first hot air chamber and for delivering the fabric piece to the second hot air chamber.

11 Claims, 5 Drawing Sheets

TRIPLE PASS TUNNEL FINISHER

This application claims the benefit of Provisional Application No. 60/685,900 filed on May 31, 2005.

TECHNICAL FIELD AND BACKGROUND OF THE INVENTION

This invention relates to a triple pass tunnel finisher. Tunnel finishers are used to remove wrinkles which are set into fabric or garments during the laundry process. In many cases, they are also used to dry the garments after laundering.

Conventional tunnel finishers are commonly referred to as "straight-through" or "U-turn" tunnel finisher based on their shape. In a "straight-through" finisher, damp garments on a hanger enter one end and pass in a straight line through the finisher, exiting on the other end. In a "U-turn" finisher, damp garments on a hanger enter and exit on the same end of the finisher, making a U-turn at the opposite end.

A tunnel finisher finishes a garment by subjecting the garment to a steaming zone and a hot air zone. In the steaming zone, a garment is conditioned with live steam injection before it proceeds to the hot air zone. In the hot air zone, the garment is heated and agitated with hot air to evaporate moisture from the garment. This process causes the fibers in the garment to return to their natural, relaxed, wrinkle free condition.

The efficiency of a tunnel finisher and the quality of the appearance of the garment after processing is dependent on the dwell time of the garment inside the machine. The garment must remain in the finisher for a length of time sufficient to permit the temperature of the garment to be raised to the correct temperature well above the evaporation point of water so that the remaining moisture in the garment is evaporated. Dwell time must also be compatible with the daily production needs.

Conventional tunnel finishers include, in a single cabinet, all of the functioning elements necessary for the operation of the finisher. Therefore, laundries need to purchase a finisher with a capacity large enough to handle present production levels as well as production increases over a long period of time. Most tunnel finishers are manufactured in such a manner that when production levels increase, a new finisher must be purchased.

This invention provides a triple pass tunnel finisher with a full length steam injection chamber and two separate hot air chambers. This allows for a substantially increased dwell time to permit evaporation of the remaining moisture in the garment. Increased dwell time also allows the triple pass tunnel finisher to handle larger production levels than conventional tunnel finishers. Further, the triple pass tunnel finisher is easily expandable in increments at substantially less cost than purchasing complete additional tunnel finishers.

SUMMARY OF THE INVENTION

Therefore, it is an object of the invention to provide a triple pass tunnel finisher which has expanded steam injection and hot air chambers.

It is another object of the invention to provide a triple pass tunnel finisher which provides a more effective method of injecting steam into a garment.

It is another object of the invention to provide a triple pass tunnel finisher with two hot air chambers with equal air flow.

It is another object of the invention to provide a triple pass tunnel finisher which includes one or more expansion modules varying in length which can be inserted between the original machine modules for increasing the dwell time of the garments in the tunnel finisher.

It is another object of the invention to provide a triple pass tunnel finisher which includes a separable front module, side steaming module, and rear module which collectively contain all of the necessary functioning components of the finisher, whereby the modules, when separated, accommodate between the first and rear module at least one expansion module which permits additional dwell time of the garments in the tunnel finisher.

These and other objects of the present invention are achieved in the preferred embodiments disclosed below by providing a tunnel fabric finishing apparatus including a side module, a front module, and a rear module. The side module having an entrance for receiving a fabric piece to be conveyed through the apparatus, and a steam injection chamber downstream of the entrance for treating the fabric piece with steam. The front module communicating with the side module for receiving the fabric piece conveyed therefrom, and including first and second hot air chambers, and an exit downstream of the second hot air chamber. The rear module communicating with the front module for receiving the fabric piece therefrom, and including a heating apparatus for heating the fabric piece, and a U-shaped intermediate hot air chamber downstream from the first hot air chamber and upstream from the second hot air chamber for receiving the fabric piece from the first hot air chamber and for delivering the fabric piece to the second hot air chamber.

According to another preferred embodiment of the invention, the front and rear modules are separable for receiving therebetween at least one expansion module to provide the fabric finishing apparatus with an extended hot air zone sufficient to permit accelerated flow of the fabric piece through the finishing apparatus while maintaining sufficient dwell time of the fabric piece in the finishing apparatus to permit completed finishing at the accelerated rate of flow of the fabric piece.

According to another preferred embodiment of the invention, the side module includes a steam injector downstream of the entrance and positioned at an angle relative to a wall of the steam injection chamber for injecting the fabric piece with steam.

According to another preferred embodiment of the invention, the steam injector is adjacent the entrance.

According to another preferred embodiment of the invention, the steam injector is adjacent an exit of the side module and an entrance of the front module.

According to another preferred embodiment of the invention, the side module includes first and second steam injectors downstream of the entrance for injecting the fabric piece with steam.

According to another preferred embodiment of the invention, the first steam injector is positioned adjacent the entrance of the side module at an angle relative to a wall of the steam injection chamber, and the second steam injector is positioned adjacent an exit of the side module and an entrance of the front module at an angle relative to a wall of the steam injection chamber.

According to another preferred embodiment of the invention, the side module includes an exhaust hood for exhausting moisture-laden air from the steam injection chamber.

According to another preferred embodiment of the invention, the front module includes a blower for circulating hot air through the tunnel.

According to another preferred embodiment of the invention, the front module includes an exhaust hood for exhausting moisture-laden air from the finishing apparatus.

According to another preferred embodiment of the invention, a tunnel fabric finishing apparatus including a side module, a front module, a rear module, and at least one expansion module. The side module having an entrance for receiving a fabric piece to be conveyed through the apparatus, and a steam injection chamber downstream of the entrance for treating the fabric piece with steam. The front module communicating with the side module for receiving the fabric piece conveyed therefrom, and including first and second hot air chambers, and an exit downstream of the second hot air chamber. The rear module communicating with the front module for receiving the fabric piece therefrom, and including a heating apparatus for heating the fabric piece, and a U-shaped intermediate hot air chamber downstream from the first hot air chamber and upstream from the second hot air chamber for receiving the fabric piece from the first hot air chamber and for delivering the fabric piece to the second hot air chamber. The at least one expansion module positioned intermediate the front module and the rear module for providing the fabric finishing apparatus with an extended hot air zone sufficient to permit accelerated flow of the fabric piece through the finishing apparatus while maintaining sufficient dwell time of the fabric piece in the finishing apparatus to permit completed finishing at the accelerated rate of flow of the fabric piece.

According to another preferred embodiment of the invention, the at least one expansion module includes an expansion hot air chamber cooperating with the first, intermediate, and second hot air chambers.

According to another preferred embodiment of the invention, the side module includes a plurality of steam injectors downstream of the entrance for injecting the fabric piece with steam.

According to another preferred embodiment of the invention, a method of finishing a fabric piece includes the steps of providing a fabric finishing apparatus having a side module with an entrance and a steam injection chamber, a front module communicating with the side module, and a rear module communicating with the front module; conveying a fabric piece through an entrance of the side module and into the steam injection chamber; injecting steam into the fabric piece; conveying the fabric piece through hot air chambers of the front and rear modules; and conveying the fabric piece through an exit of the front module.

According to another preferred embodiment of the invention, further including the step of spreading the fabric piece open to allow the steam to fully penetrate the fabric piece.

According to another preferred embodiment of the invention, further including the step of closing the fabric piece to allow the fabric piece to be dried by the hot air chambers.

According to another preferred embodiment of the invention, the steam chamber includes at least one steam injector downstream of the entrance and positioned at an angle relative to a wall of the steam injection chamber for injecting the fabric piece with steam.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
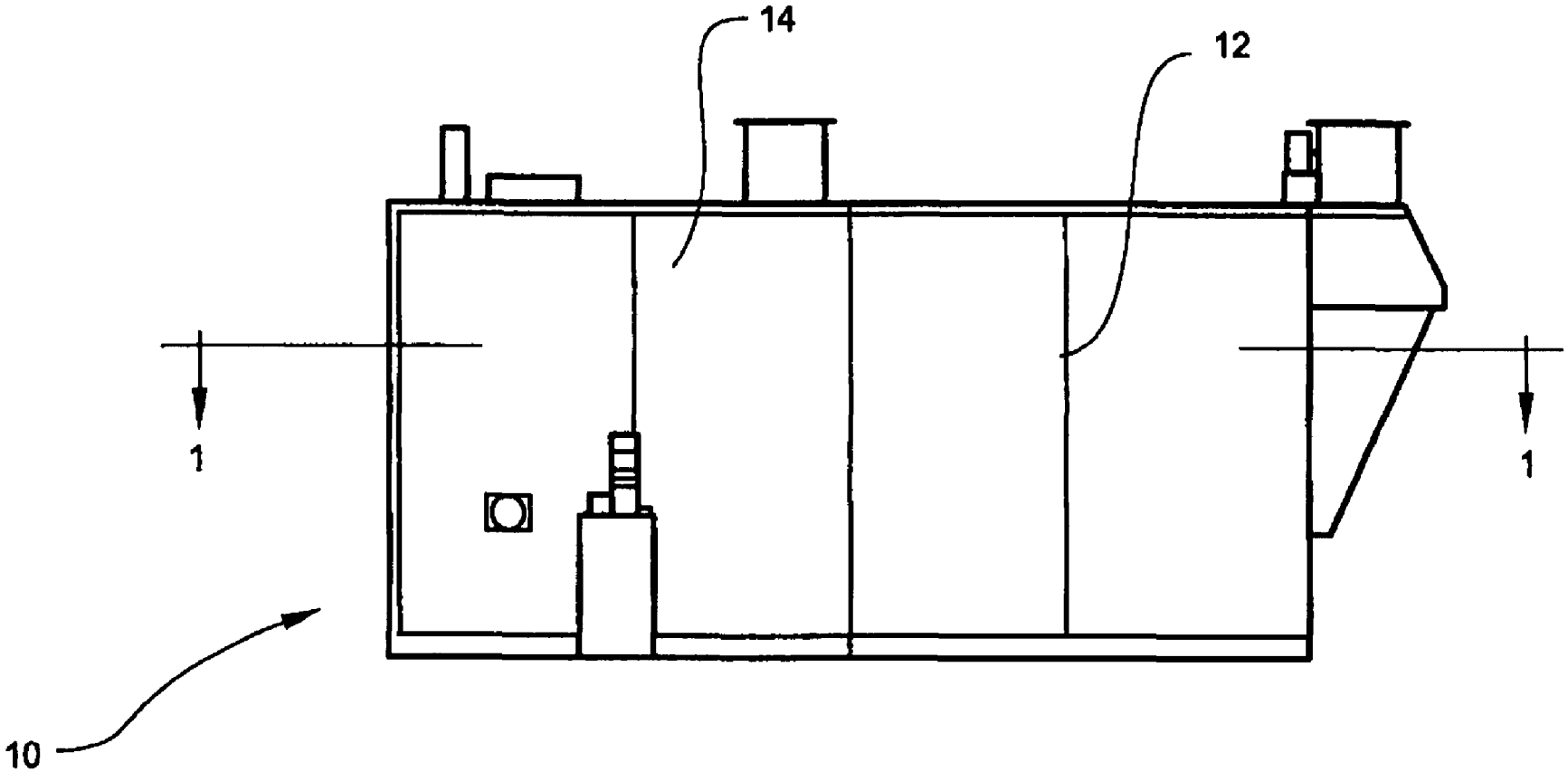
FIG. 1 is a side elevation of a triple pass tunnel finisher according to a preferred embodiment of the invention.

Referring now specifically to the drawings, a triple pass tunnel finisher according to the present invention is illustrated in FIGS. 1, 2, 3, 4, and 5 and is shown generally at reference numeral 10. The triple pass tunnel finisher 10 comprises a front module 12 and rear module 14. See FIG. 1. The front module 12 contains a blower for circulating hot air through the entire tunnel finisher 10, electric controls, including thermostats, for controlling temperature, a main operator control panel, and a large portion of the hot air chambers 20. The rear module 14 contains a portion of the hot air chambers 20 including the U-turn as well as the heat source which may be a steam heat exchanger, electric heating coils, or one or more gas burners. The side steaming module 16 contains the entire steam injection chamber and steam exhaust hood.

Figure 2:
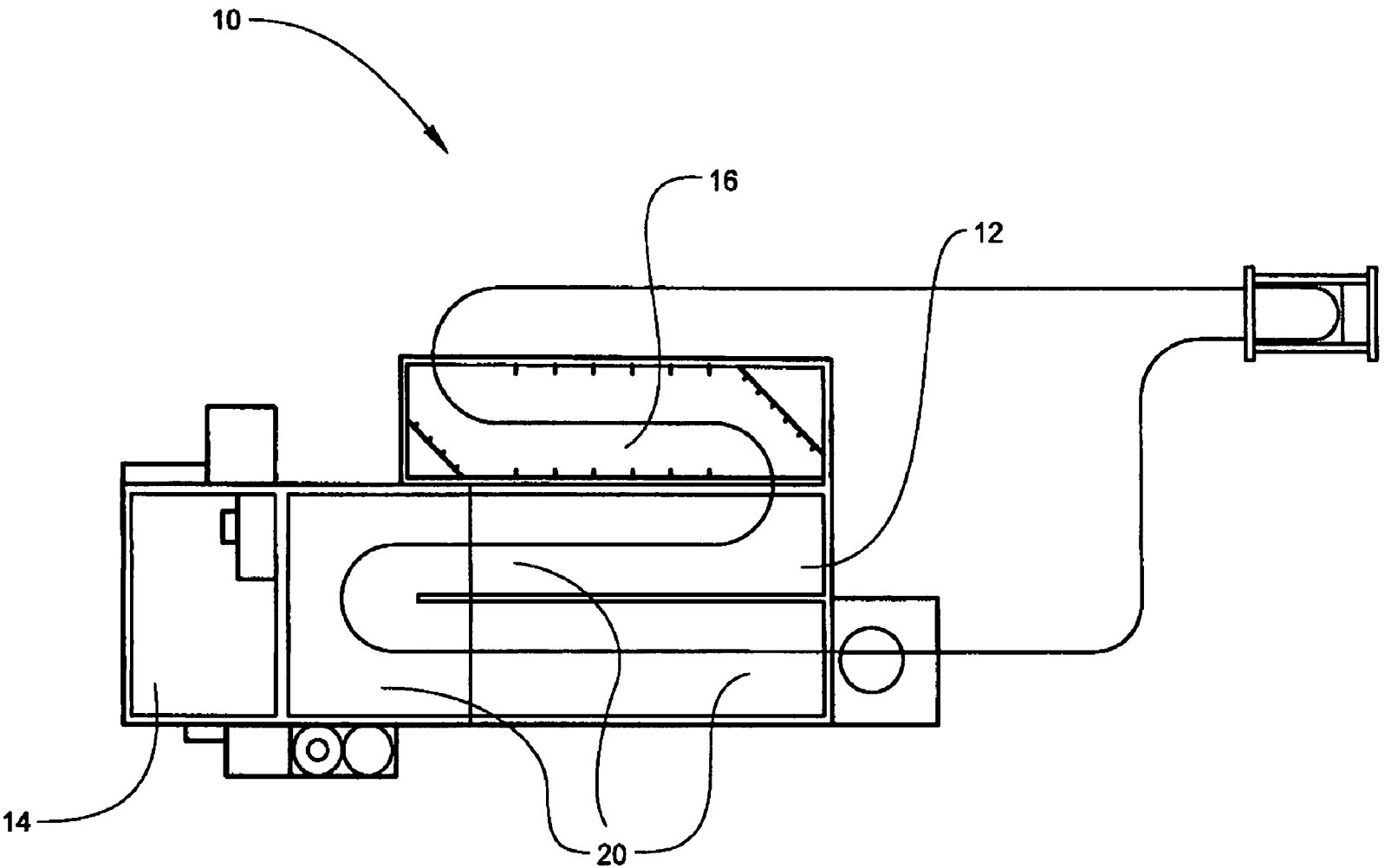
FIG. 2 is a horizontal cross-section of the triple pass tunnel finisher taken through line 1-1 of FIG. 1.

As shown in FIG. 2, the side steaming module 16 contains the entrance to the tunnel finisher 10 through which fabric pieces, such as garments, are carried on hangers by a chain conveyer into the finisher. The tunnel finisher 10 will be discussed, for simplicity, in reference to a garment; however, it should be appreciated that the tunnel finisher 10 may be used to finish various fabrics and fabric pieces. As the garment enters the side steaming module 16 on the chain conveyer, the hanger spreads the garment open as it is immediately injected with steam from a steam injector which is located at a 45° angle in relation to the chamber walls. This feature allows the steam to fully penetrate the garment and is particularly designed for the laundering of shirts and jackets. The hanger returns to its normal operating form as the garment proceeds through the remainder of the side steaming module 16. As the garment enters a U-turn to exit the side steaming module 16 and enter the front module 12, the hanger again spreads open exposing the garment to another steam injection from a steam injector located at a 45° angle in relation to the chamber walls.

The front module 12 includes the hot air chambers 20 with the exception of the single U-turn portion of the hot air chambers 20 which are located in the rear module 14. The hot air chambers 20 include two separate chambers in which air from a hot air plenum is directed down through the moving garments to complete the drying process. The two chamber arrangement allows for even air flow in each chamber resulting in an increase in the air velocity which is an improvement over the prior art. An exhaust hood is also carried by the front module 12 for exhausting moisture-laden air from the finisher 10.

Figure 3:
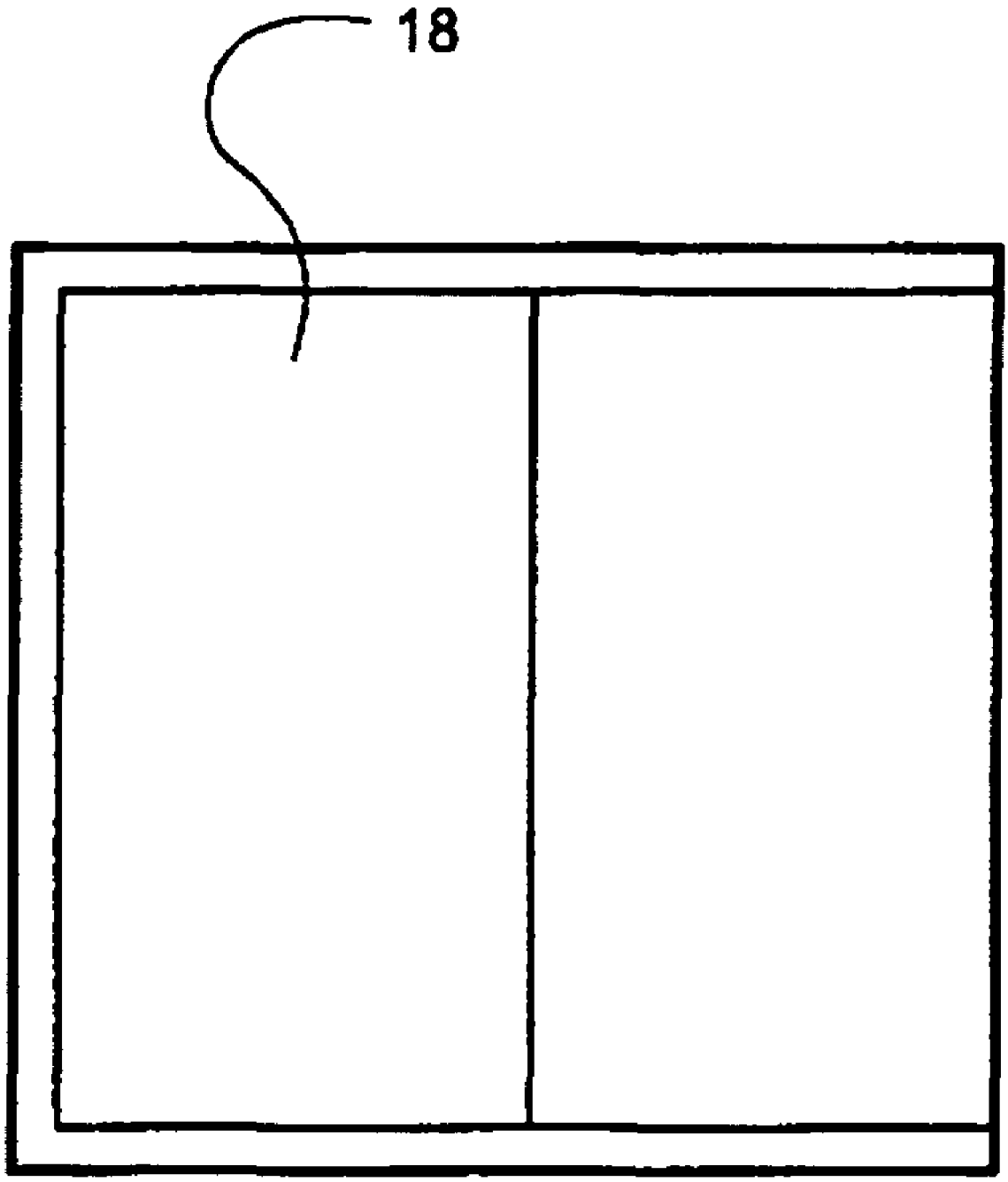
FIG. 3 is a side view of the expansion module.
Figure 4:
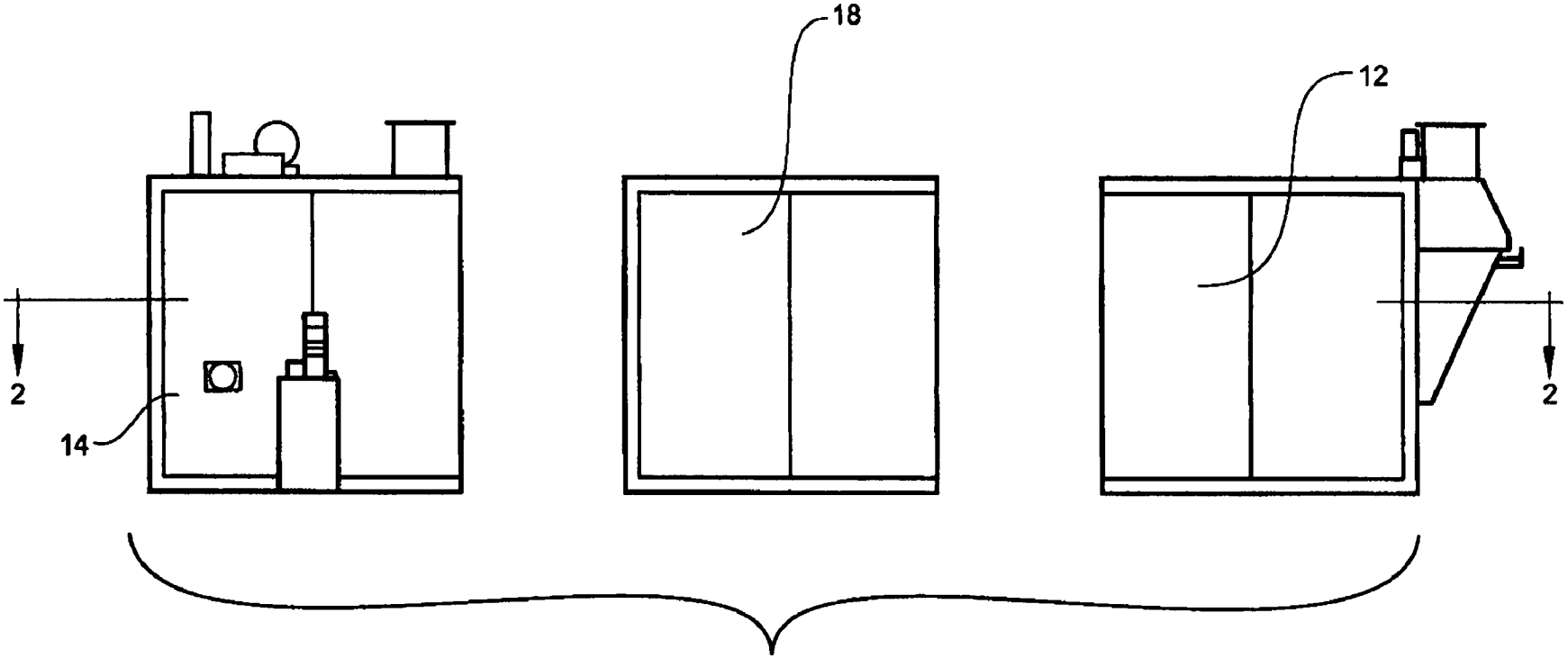
FIG. 4 is a side elevation of a triple pass tunnel finisher with a single expansion module according to the preferred embodiment.
Figure 5:
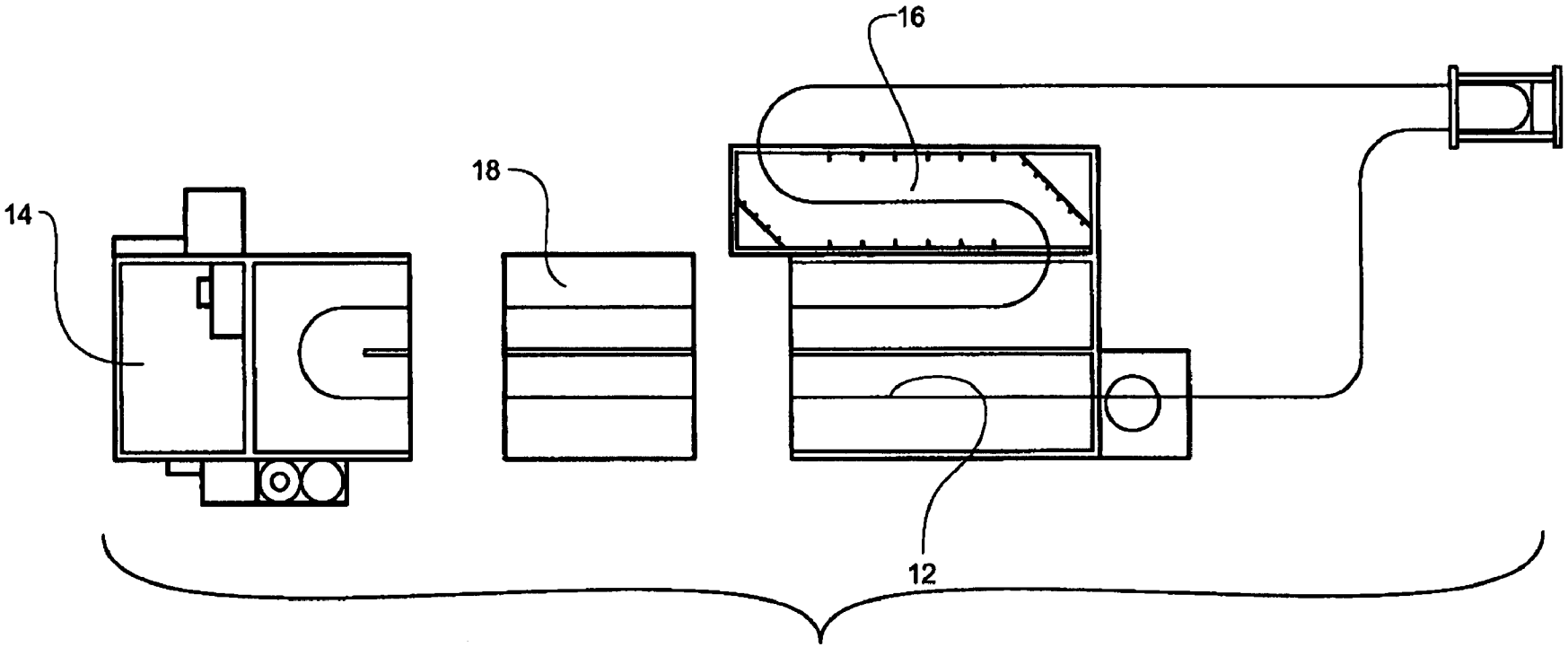
FIG. 5 is a horizontal cross-section of the triple pass tunnel finisher with a single expansion module according to the preferred embodiment taken through line 2-2 of FIG. 4.

The front module 12, rear module 14, and side steaming module 16 collectively comprise an entire functioning finisher 10, and so long as production capacity is met, need not be changed. However, an increase in production can be easily and inexpensively met by unbolting the modules from each other, spreading them apart, and inserting, between the front module 12 and rear module 14, an expansion module 18, as shown in FIGS. 3, 4, and 5. The expansion module 18 contains only an airflow plenum needed to direct heated air onto the garments. The conveyor chain and piping are lengthened to accommodate the new, longer length, and the system is complete. The simple construction of the expansion module 18 and the lack of need for other functional components provides a very inexpensive way of increasing production. There is no need for additional electronics, heating capacity, or blowers. Furthermore, the expansion modules 18 may be manufactured in various lengths according to customer specifications.

A triple pass tunnel finisher is described above. Various details of the invention may be changed without departing from its scope. Furthermore, the foregoing description of the preferred embodiment of the invention and the best mode for practicing the invention are provided for the purpose of illustration only and not for the purpose of limitation.

I claim:

1. A triple pass tunnel fabric finishing apparatus, comprising:

a conveyor having a serpentine conveyor path;

a first, a second, and a third linear tunnel arranged in a continuous, side-by-side manner and defining a portion of the serpentine conveyor path, the tunnels defining a first U-turn of the conveyor path at an entrance to the first tunnel, a second U-turn of the of the conveyor bath between an exit of the first tunnel and an entrance of the second tunnel, and a third U-turn of the conveyor path between an exit of the second tunnel and an entrance of the third tunnel, wherein said U-turns provide a curved pathway while conveyor paths though the first and the third tunnels are generally parallel and a conveyor path through the second tunnel is generally anti-parallel to the conveyor paths through the first and the third tunnels;

a steam injector disposed in the first linear tunnel and positioned adjacent an outer curve of the first or second U-turn; and a hot air chamber disposed in at least one of the second and third linear tunnels.

2. The finishing apparatus according to claim 1, wherein each of the first, second and third linear tunnels are comprised of a plurality of modules separable to receive expansion modules therebetween.

3. The finishing apparatus according to claim 1, wherein the first linear module is a steaming module and includes the steam injector downstream of the entrance and positioned proximate the first U-turn.

4. The finishing apparatus according to claim 3, wherein the steam injector is adjacent the entrance.

5. The finishing apparatus according to claim 1, wherein the steam injector is positioned adjacent the second U-turn.

6. The finishing apparatus according to claim 1, wherein the first tunnel includes a first steam injector positioned adjacent the first U-turn and a second steam injector positioned adjacent the second U-turn.

7. The finishing apparatus according to claim 6, wherein the first steam injector is positioned adjacent the entrance of the first tunnel and the second steam injector is positioned adjacent the exit of the first tunnel.

8. The finishing apparatus according to claim 1, wherein the first tunnel includes an exhaust hood for exhausting moisture-laden air.

9. The finishing apparatus according to claim 1, wherein at least one of the second and third tunnels includes a blower for circulating hot air through the tunnels.

10. The finishing apparatus according to claim 1, wherein at least one of the second and third tunnels includes an exhaust hood for exhausting moisture-laden air from the finishing apparatus.

11. A method of finishing a fabric piece, comprising the steps of:

(a) providing a fabric finishing apparatus comprising:

a conveyor having a serpentine conveyor path;

a first, a second, and a third linear tunnel arranged in a continuous, side-by-side manner and defining a portion of the serpentine conveyor path, the tunnels defining a first U-turn of the conveyor path at an entrance to the first tunnel, a second U-turn of the of the conveyor bath between an exit of the first tunnel and an entrance of the second tunnel, and a third U-turn of the conveyor path between an exit of the second tunnel and an entrance of the third tunnel, wherein said U-turns provide a curved pathway while conveyor paths though the first and the third tunnels are generally parallel and a conveyor path through the second tunnel is generally anti-parallel to the conveyor paths through the first and the third tunnels;

a steam injector disposed in the first linear tunnel and positioned adjacent an outer curve of the first or second U-turn; and a hot air chamber disposed in at least one of the second and third linear tunnels;

(b) conveying a fabric piece through the entrance of the first tunnel;

(c) injecting steam into the fabric piece;

(d) conveying the fabric piece through the hot air chamber of the second and third tunnels; and (e) conveying the fabric piece through the exit of the third tunnel.

* * * * *